US006769492B2

(12) United States Patent
Bauer et al.

(10) Patent No.: US 6,769,492 B2
(45) Date of Patent: Aug. 3, 2004

(54) FIRE EXTINGUISHER

(75) Inventors: Karl Bauer, Soyen (DE); Joachim Sans, Putzbrunn (DE); Steffen Schilling, Kraiburg (DE)

(73) Assignee: Bayern-Chemie GmbH, Aschau am Inn (DE)

( * ) Notice: Subject to any disclaimer, the term of this patent is extended or adjusted under 35 U.S.C. 154(b) by 0 days.

(21) Appl. No.: 10/258,535

(22) PCT Filed: Apr. 26, 2001

(86) PCT No.: PCT/DE01/01574

§ 371 (c)(1),
(2), (4) Date: Oct. 23, 2002

(87) PCT Pub. No.: WO01/83032

PCT Pub. Date: Nov. 8, 2001

(65) Prior Publication Data

US 2003/0173093 A1 Sep. 18, 2003

(51) Int. Cl.[7] ..... A62C 1/00
(52) U.S. Cl. ..... 169/30
(58) Field of Search ..... 169/5–12, 26, 169/27, 28, 30, 61, 62, 77, 78, 84

(56) References Cited

U.S. PATENT DOCUMENTS

| | | | | |
|---|---|---|---|---|
| 2,383,048 A | | 8/1945 | Eckert, Jr. | 169/28 |
| 2,838,122 A | | 6/1958 | Hutchinson | 169/1 |
| 4,197,213 A | * | 4/1980 | Pietz et al. | 252/372 |
| 4,760,886 A | | 8/1988 | Sassier | 169/28 |
| 5,038,866 A | * | 8/1991 | Kern et al. | 169/28 |
| 5,291,952 A | | 3/1994 | Arend | 169/71 |
| 5,609,210 A | | 3/1997 | Galbraith et al. | 169/26 |
| 5,613,562 A | | 3/1997 | Galbraith et al. | 169/12 |
| 6,006,842 A | | 12/1999 | Stilwell et al. | 169/60 |

FOREIGN PATENT DOCUMENTS

| | | |
|---|---|---|
| DE | 42 24 184 A1 | 1/1994 |
| DE | 195 44 399 A | 6/1997 |
| DE | 199 34 164 A | 7/1999 |
| GB | 2 350 294 A | 11/2000 |
| WO | WO 94/06515 | 3/1994 |
| WO | WO 98/39064 | 9/1998 |

* cited by examiner

*Primary Examiner*—Michael Mar
*Assistant Examiner*—Thach H Bui
(74) *Attorney, Agent, or Firm*—Flynn, Thiel, Boutell & Tanis, P.C.

(57) ABSTRACT

A fire extinguisher includes a compressed gas generator for fighting fires and nascent explosions, and has two bursting membranes with predetermined breaking points for closing the fire extinguishing material container. The predetermined breaking points of the bursting membranes are designed with differences in resistance in order to achieve a time delay between the breaking occurrences of the two predetermined breaking points. This time delay ensures a non-deformed and rotationally symmetrical expulsion of the fire extinguishing material.

11 Claims, 2 Drawing Sheets

FIRE EXTINGUISHER

FIELD OF THE INVENTION

The invention relates to a fire extinguisher for fighting fires and nascent explosions, with a compressed gas generator and a fire extinguishing material container, as well as an initial bursting membrane closing the fire extinguishing material container with a convex surface facing the compressed gas generator, and a further bursting membrane closing the fire extinguishing material container on the exit side, the membranes having predetermined breaking points. The gas pressure of the triggered compressed gas generator causes the membrane to change over from a convex to a concave curvature in accordance with German Patent Publication DE 199 34 164.8.

BACKGROUND OF THE INVENTION

For the suppression of nascent explosions, e.g. of mill dusts, coal dusts, solvent vapours and the like, containers under permanent pressure filled with fire extinguishing material (usually fire extinguishing powder) are usually used; when required, these blow the fire extinguishing material into the area where the fire is to be extinguished by means of a fast-opening valve.

A fire extinguisher whose fire extinguishing material container is closed by a flat bursting disk which opens at a relatively low overpressure of 0.1 to 1 bar is known from DE 42 24 184 A1. At least one compressed gas generator, which when triggered leads to a mixing of the fire extinguishing material with the compressed gas and sprays this mixture into the area to be protected, is connected to the fire extinguishing material container.

In the fire extinguisher in accordance with AT-E 53 948 B, a fire extinguishing material container, which is filled with liquid freon and nitrogen under high pressure, is closed by a flat bursting membrane which is torn by a detonating charge located in the immediate vicinity.

A fire extinguisher with a compressed gas generator, in which the fire extinguishing material container is closed by two flat bursting membranes, is known from DE 195 44 399 C2. The extinguishing results achieved by this fire extinguisher are only moderately good, since the bursting membranes often break open for undefined reasons.

From publication DE 199 34 164.8, the applicant knows of a fire extinguisher in which the fire extinguishing material container is closed by two spherically convex bursting membranes which are curved towards the compressed gas generator and which have an embossed predetermined breaking point. When pressure is applied, these bursting membranes indent at one point, and turn their curvature over towards the other side. In the course of this changeover from convex to concave, the membranes break almost simultaneously at the predetermined breaking points, leading to an insufficiently high pressure build-up between the compressed gas generator and the fire extinguishing material. This behaviour has an adverse effect on the spray pattern. In order to achieve an optimum spray pattern and thus good extinguishing results, however, it is necessary that the entire fire extinguishing material should be expelled uniformly.

The task of the invention in hand is to improve the described state of technology by preventing the bursting membranes from bursting simultaneously and allowing and supporting a further pressure build-up between the compressed gas generator and the fire extinguishing material.

SUMMARY OF THE INVENTION

This task is solved in accordance with the invention through Claim 1 in that in the course of the changeover of curvature, the resistance of the predetermined breaking point of the first bursting membrane is designed to be higher than the resistance of the predetermined breaking point of the further bursting membrane. In accordance with Claim 2, the resistance of the predetermined breaking point of the first bursting membrane is calculated in such a way that after the changeover in curvature has taken place, the breaking limit is only reached when the internal pressure increases further. Claim 3 establishesthat the fire extinguishing material container has two differently shaped bursting membranes.

The special advantage of the invention can be seen in that the sequence of the turning over of the curvature of both bursting membranes and the successive breaking of the predetermined breaking points is optimised in time in such a way that the fire extinguishing material is expelled from the fire extinguisher uniformly and is not asymmetrically deformed, thus leading to a fire extinguishing material distribution which is uniform in all directions.

BRIEF DESCRIPTION OF THE DRAWINGS

An embodiment is described in greater detail in the following and is illustrated in a simplified form in the drawing.

DETAILED DESCRIPTION

Figure 1:
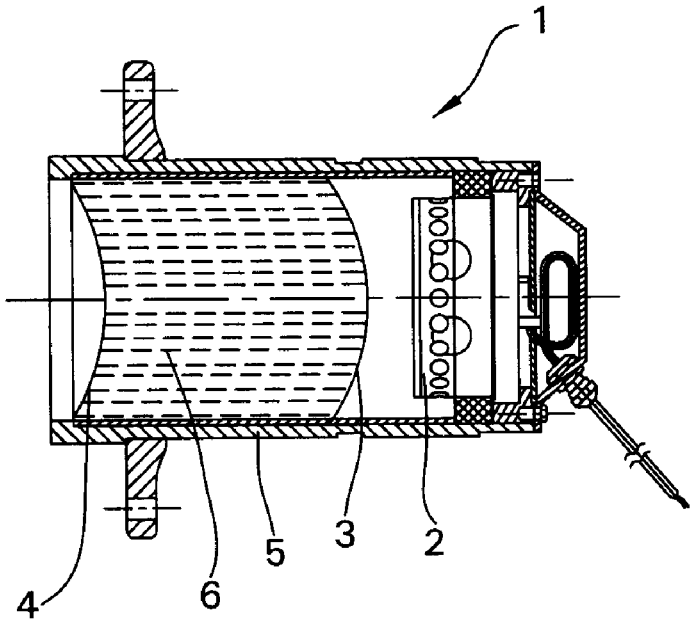
FIG. 1 shows the construction of a fire extinguisher with a compressed gas generator and with concave membranes in accordance with the state of technology.

FIG. 1 shows a fire extinguisher 1 of known design which contains a pyrotechnical gas generator 2. The bursting membranes 3 and 4 are concave with respect to the pyrotechnical gas generator 2 and close the fire extinguishing material container 5 in such a way that the fire extinguishing material 6 cannot escape. The bursting membranes 3 and 4 are spherically shaped and have predetermined breaking points in their membrane surfaces. In the event of the application of pressure, such bursting membranes indent at some point by chance or at a material-specific weak point. In the event of a distinct indentation, the next predetermined breaking point begins to break open.

Figure 2:
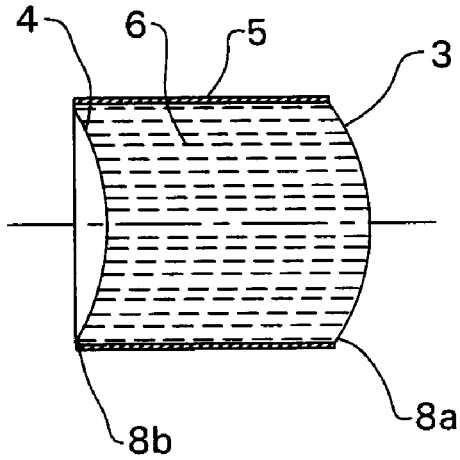
FIG. 2 shows a cross-section of a fire extinguishing material container with two convex bursting membranes.

To prevent such an occurrence, it was proposed in Publication DE 199 34 164.8 that the bursting membranes should be shaped as illustrated in FIG. 2. Here, the centre of the bursting membrane is designed as a flat surface. At the edges of the bursting membranes 3, 4 are the circularly embossed predetermined breaking points 8*a*, 8*b*. The central flat surfaces help to ensure that temperature-specific volume fluctuations are compensated for by means of a cushioning movement of the flat surface in the direction of the main axis A of the fire extinguisher 1. In the event that the gas generator 2 should be triggered, the two membranes 3, 4 change their curvatures simultaneously and the predetermined breaking points 8*a*, 8*b*, which have been weakened by this change in curvature, break open.

Figure 3:
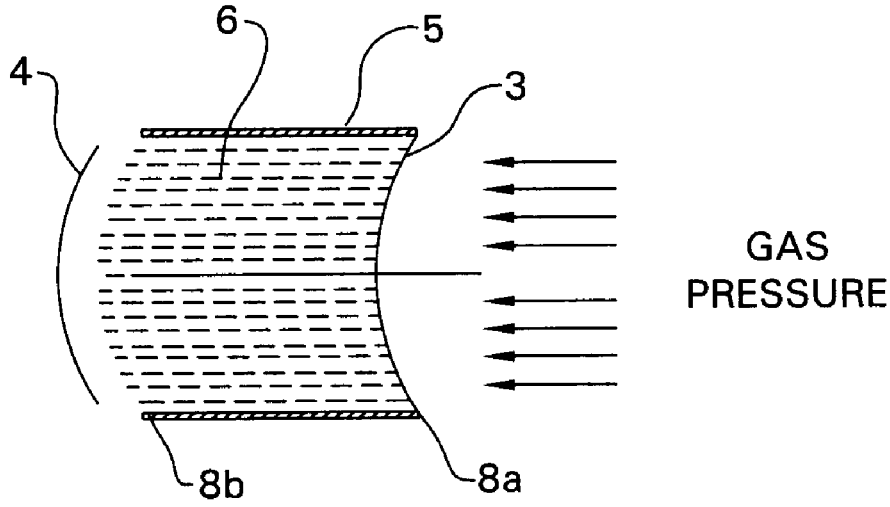
FIG. 3 shows a cross-section of a fire extinguishing material container with a first bursting membrane which initially is still intact.

In accordance with the invention, the predetermined breaking points 8*a*, 8*b* are designed differently with respect to their resistance. As illustrated in FIG. 3, the pressure given off by gas generator 2 builds up within a few milliseconds. This initially causes the two bursting membranes 3, 4 to change their curvatures at the same time. On account of the higher resistance of the predetermined breaking point 8*a* of the first bursting membrane 3, the latter does not break initially, while the further bursting membrane 4 on the exit side shears off at its circumference and is expelled. After the bursting membranes 3, 4 change their curvatures, a further increase in pressure is caused by the compressed air generator 2.

Figure 4:
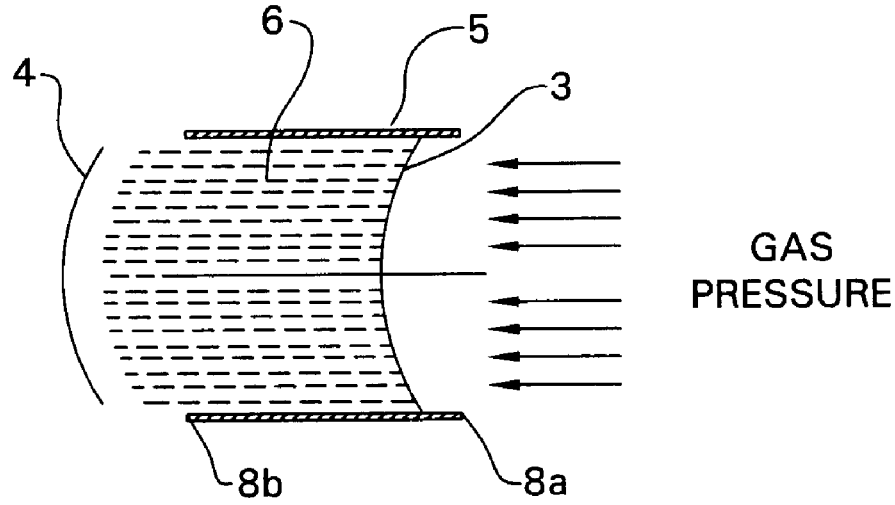
FIG. 4 shows a fire extinguishing material container in accordance with FIG. 3 with a first bursting membrane which has broken after a time delay.

As shown in FIG. 4, the first bursting membrane 3 only breaks after a further increase in pressure. As a result of this, the fire extinguishing material 6 is expelled evenly from the fire extinguishing material container 5 through the preloaded pressure and is not deformed to the one side. Only after the fire extinguishing material 6 has been expelled from the fire extinguishing material container 5 does its fine scattering effect begin.

The increased resistance of the first membrane 8*a*[1] can be achieved either by greater material thickness at the predetermined breaking point or by using a material with greater resistance or strength. It is also conceivable that the resistance of the predetermined breaking point could be influenced by the design of the notch.

[1]A.d.Ü.: MÜβte der ersten Membran nicht die Zahl 3 zugeordnet werden?

In accordance with Claim 3, membranes (8*a*, 8*b*)[2] with different material thicknesses have proved to be advantageous. Differently shaped membranes have also proved to be favourable in experiments. Here, membrane 8*a*[3] was spherically curved. The second membrane was also spherically curved at the edge, but its centre was designed as a plane surface. It is also conceivable that the predetermined breaking points could be of different designs.

[2]A.d.Ü.: Auch hier werden den Membranen Ziffern zugeordnet, die zuvor den Sollbruchstellen zugeordnet waren

[3]dito

What is claimed is:

1. Fire extinguisher for fighting fires and nascent explosions comprising a compressed gas generator, a fire extinguishing material container containing the gas generator, a first bursting membrane closing the fire extinguishing material container with a convex surface facing the compressed gas generator and a second bursting membrane closing the fire extinguishing material container on an exit side of said container, said first and second membranes having predetermined breaking points, and gas pressure caused by the triggered compressed gas generator causing the membrane to change over from a convex to a concave curvature and wherein in the course of the change in curvature, the resistance of the predetermined breaking point of the first bursting membrane is greater than the resistance of the predetermined breaking point of the second bursting membrane.

2. The fire extinguisher in accordance with claim 1, wherein the resistance of the predetermined breaking point of the first bursting membrane is calculated so that after the change in curvature has taken place, the breaking point is only reached when the internal pressure increases further.

3. The fire extinguisher in accordance with claim 1, wherein the first and second bursting membranes have different shapes.

4. A fire extinguisher for fighting fires and nascent explosions comprising:

a fire extinguishing material container having a first end and a second end;

a compressed gas generator for outputting gas pressure located at the first end of said container;

a first bursting membrane closing said fire extinguishing material container adjacent said compressed gas generator, said first bursting membrane having an outward face facing said compressed gas generator, said first bursting membrane having a first pressure that causes a change in shape;

a second bursting membrane closing said fire extinguishing material container at the second end and spaced from said first bursting membrane, the first pressure causing a change of shape of the second bursting membrane; and a fire extinguishing material contained within said fire extinguishing material container and located between an inward face of said first bursting membrane and an inward face of said second bursting membrane;

said first membrane having a predetermined breaking point which is higher than the predetermined breaking point of said second membrane;

wherein a triggering of said compressed gas generator provides gas pressure against the outward face of said first bursting membrane and thus changes the shape of said first bursting membrane and said second bursting membrane; and wherein said second bursting membrane bursts before said first bursting membrane.

5. The fire extinguisher in accordance with claim 4, wherein the face of said first bursting membrane changes curvature from a convex face facing the compressed gas generator to a concave face and said second bursting membrane changes curvature from a convex face facing said extinguishing material to a concave face when a triggering of said compressed gas generator occurs.

6. The fire extinguisher in accordance with claim 5, wherein said first bursting membrane, after said first and second bursting membranes change to a concave face, requires a further or continuing increase in pressure to burst.

7. The fire extinguisher in accordance with claim 4, wherein said first and second bursting membranes have different shapes.

8. The fire extinguisher in accordance with claim 7, wherein said second bursting membrane has a central plane surface and is spherically curved at an edge closing said fire extinguishing material container.

9. The fire extinguisher in accordance with claim 4, wherein said first bursting membrane has a greater thickness than said second bursting membrane.

10. The fire extinguisher in accordance with claim 4, wherein said second bursting membrane bursts a predetermined time before said first bursting membrane to ensure a non-deformed and rotationally symmetrical expulsion of the fire extinguishing material.

11. The fire extinguisher in accordance with claim 4, wherein said fire extinguishing material container has a cylindrical shape and during bursting, said second bursting membrane shears off about a circumference thereof and is expelled.

* * * * *